US009371999B2

(12) United States Patent
Vulpitta et al.

(10) Patent No.: US 9,371,999 B2
(45) **Date of Patent: *Jun. 21, 2016**

(54) FIREPLACE DRAFT BLOCKER

(75) Inventors: Brian A. Vulpitta, Avon Lake, OH (US); Vageesh Bakhshi, Brecksville, OH (US); Daniel Festa, Strongsville, OH (US)

(73) Assignee: ShurTech Brands, LLC, Avon, OH (US)

( * ) Notice: Subject to any disclaimer, the term of this patent is extended or adjusted under 35 U.S.C. 154(b) by 1044 days.

This patent is subject to a terminal disclaimer.

(21) Appl. No.: 13/495,493

(22) Filed: Jun. 13, 2012

(65) Prior Publication Data

US 2013/0333687 A1 Dec. 19, 2013

(51) Int. Cl.
*F24B 1/192* (2006.01)
*F24B 1/191* (2006.01)
*A47G 5/04* (2006.01)

(52) U.S. Cl.
CPC ..... *F24B 1/192* (2013.01)

(58) Field of Classification Search
CPC ..... A47G 5/04
USPC ..... 126/545, 531, 547; 135/96, 137; 160/351, 354, 368.1, 41
See application file for complete search history.

(56) References Cited

U.S. PATENT DOCUMENTS 65,673 A * 6/1867 Holland ..... A47G 5/04 160/351
972,636 A 10/1910 Pafford
1,590,396 A * 6/1926 Sutton ..... F24B 1/192 126/547
1,926,443 A 9/1933 Jackson
2,501,278 A * 3/1950 Hughes ..... A47G 5/02 126/548
2,549,850 A * 4/1951 Pedersen ..... A47G 5/04 160/368.1
3,375,818 A * 4/1968 Luther ..... F24B 1/192 126/546
3,830,219 A 8/1974 Gibbs
4,010,730 A 3/1977 Mitchell
4,015,581 A * 4/1977 Martenson ..... 126/531
4,072,140 A * 2/1978 Gallagher ..... 126/547
4,154,217 A 5/1979 Buckner
4,294,224 A 10/1981 Luther
4,967,731 A * 11/1990 Terhune ..... F24B 1/192 126/521
D396,001 S 7/1998 Crumpler
6,167,898 B1 * 1/2001 Larga et al. ..... 135/137
6,298,844 B1 10/2001 Skinkiss
6,450,186 B1 * 9/2002 Pearcy ..... 135/96
6,539,936 B2 4/2003 Behn
6,748,943 B1 6/2004 Krimmer
8,261,736 B1 * 9/2012 Olivarri ..... 126/547
8,757,186 B2 * 6/2014 Vulpitta et al. ..... 135/96
2009/0173460 A1 * 7/2009 Handwerker ..... E04G 21/24 160/351
2013/0333687 A1 * 12/2013 Vulpitta et al. ..... 126/545

* cited by examiner

*Primary Examiner* — Steven B McAllister
*Assistant Examiner* — Desmond C Peyton
(74) *Attorney, Agent, or Firm* — Fay Sharpe LLP

(57) ABSTRACT

A fireplace draft blocker which is easily assembled and disassembled is provided with a seal around its periphery of faux fur, bristles, or soft fabric and is supported by crossed rods which hold the four corners of the fireplace draft blocker in position and away from the fireplace itself.

13 Claims, 8 Drawing Sheets

FIREPLACE DRAFT BLOCKER

BACKGROUND OF DISCLOSURE

This disclosure pertains products for minimizing drafts through fireplaces in residences.

Wood burning fireplaces are popular structures in homes, particularly single family homes. A wood burning fireplace often comprises a fire box with an open front and a flue connected to the top of the fire box which extends through a chimney. A damper is often located between the fire box and the flue allowing one to at least partially block the flow of air from the fire box into the flue. A masonry area in front of the fire box and in the living space of the home is often referred to as the hearth. The vertical surface surrounding the fire box opening and the living space is often masonry and is sometimes called the facing. There may also be wood elements surrounding the fireplace opening including a shelf called a mantel.

Some fireplaces are equipped with glass doors. These doors are usually openable to allow a homeowner to put logs into the fireplace for creating a fire. These glass doors often do not provide an airtight seal.

Fireplaces allow homeowners to build fires which are viewable from the living space of a home. Such fires sometimes provide radiant heat. Fires also provide a cozy ambiance on a cold winter night. Fires in fireplaces are not always efficient in heating a home. Moreover, even when not in use, fireplaces often provide paths for the escape of heated air from a home. Thus, the damper between the fire box and the flue does not always provide a good seal. There is sometimes air flow from the home into the fire box, through the damper and flue and out into the atmosphere. This is air that has already been heated and must be replaced with cold air from outside.

Additionally, cold air may enter a chimney and flue and cause a cold draft from the fireplace into the home.

The present exemplary embodiment relates to a draft blocker. It finds particular application in conjunction with a fireplace, and will be described with particular reference thereto. However, it is to be appreciated that the present exemplary embodiment is also amenable to other like applications.

BRIEF DESCRIPTION

The fireplace draft blocker of the disclosure is adapted to close the generally vertical opening of a fireplace fire box with a rectangular fireplace opening cover having four corners with sockets in each of the four corners, two rods interconnecting the four corners crossing at the cover center and holding the four corners in spaced relationship, a support holding the cover adjacent the fireplace opening and a sealing element around the periphery of the cover, the sealing element being faux fur, a body of bristles, or loose, flexible fabric.

Further, in accordance with the disclosure, the fireplace opening cover has flexible tubular elements extending from the four corners of the fireplace opening cover toward the opening cover center and the rods extend between the corners within the tubular elements crossing at or near the center.

Yet further in accordance with the disclosure, the rods are longer than the shortest distances between the corners they interconnect thereby causing the fireplace opening cover to assume a convex shape bowing away from the fireplace fire box.

Yet further in accordance with the disclosure, the two rods are composed of several separable rod segments, the rod segments adapted to be fitted together in end to end relationship when in use.

Yet further in accordance with the disclosure, the two rods are each comprised of three rod segments whereby the rods cross one another at a location other than a joint.

Still further in accordance with the disclosure, the fireplace opening cover is provided with an aperture which is closed with a sheet of low melting point plastic adapted to rupture at a selected temperature whereby air will be introduced into the fire box in a controlled manner if the temperature in the fireplace exceeds that selected temperature.

Still further in accordance with the disclosure, the low melting point plastic sheet is a polyethylene sheet with a melting temperature of about 250° F. (120° C.).

It is an object of the disclosure to provide a fireplace draft blocker which prevents the flow of air into a fireplace when held against the fireplace without requiring any permanent mounting of elements to the fireplace or its surrounding facing.

It is another object of the present disclosure to provide a fireplace opening draft blocker which seals around its edges even when applied to a non-planar surface such as a brick surface with depressed mortar joints.

It is still another object of the present disclosure to provide a fireplace blocker which is easily held in a vertical orientation against the fireplace opening without the need for permanent installation of fasteners.

It is still another object of the present disclosure to provide a fireplace draft blocker which is easily disassembled and storable in a compact state.

It is still another object of the present disclosure to provide a removable fireplace draft blocker product which can be sold in a disassembled state and easily assembled and applied to a fireplace opening by a consumer without the use of tools.

It is still another object of the present disclosure to provide a portable, removable draft blocker which is easily assembled and used; and, easily stored by a consumer.

Further objects, features and advantages of the disclosure will be apparent from the following detailed description taken in conjunction with the accompanying drawings showing a preferred embodiment.

DETAILED DESCRIPTION

Figure 1:
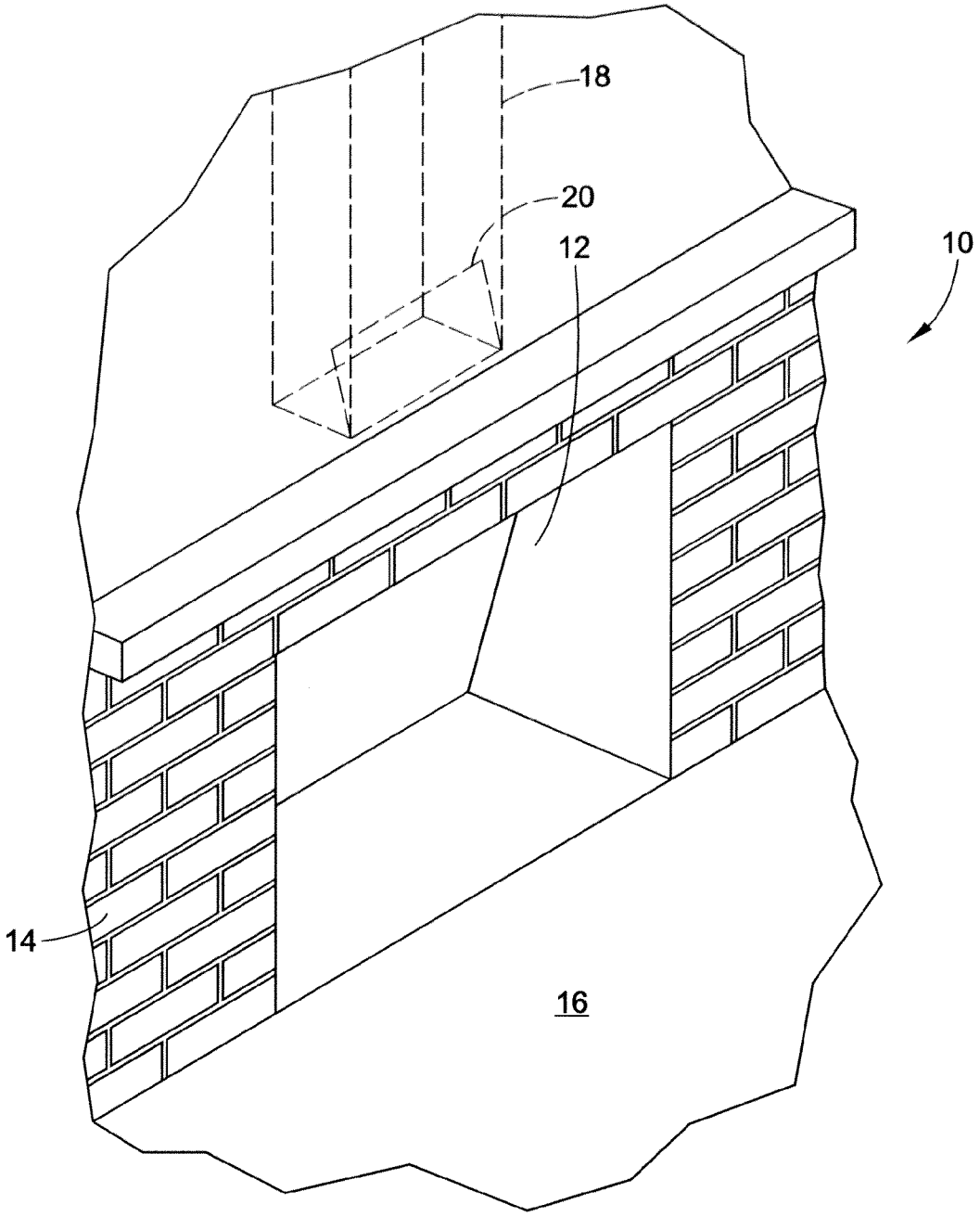
FIG. 1 is a schematical front perspective view of a conventional fireplace.

Referring now more particularly to the drawings, wherein the showings are for the purposes of illustrating preferred embodiments of the disclosure only and not for the purpose of limiting same, FIG. 1 shows, somewhat schematically, a traditional fireplace 10 as found in many homes. A firebox 12 is a recess in a surrounding wall adapted to contain a fire. The horizontal floor-like surface under the firebox 12 and adjacent the front of the firebox 12 is the hearth 16. The vertical wall surrounding the firebox 12 is often brick or other masonry and its front, outwardly facing surface is the wall face 14. The wall face 14 is often irregular. Thus, if the wall face 14 is brick, the space between adjacent bricks is often somewhat recessed and filled with mortar but not filled all the way to the front surface of the brick. Moreover, the surfaces of the bricks forming the wall face 14 are themselves often rough.

An opening in the top of the firebox 12 connects with the flue 18. The flue is adapted to carry the products of combustion created in the firebox 12 through a chimney and vent the products of combustion to the outside atmosphere. A damper 20 is located between the firebox 12 and the flue 18. In many fireplaces, the damper 20 has a handle accessible through the fascia 14 allowing one to open and close the damper 20. Not all dampers have external handles.

Dampers in fireplaces must operate in an environment which can be cold when there is no fire in the fireplace or very hot when there is a substantial fire in the fireplace. Dampers are often installed when a fireplace is built and not replaced or repaired during the lifetime of the house. Dampers often fail to seal completely when closed. Fireplaces are frequent sources of air leakage from or into homes.

Figure 2:
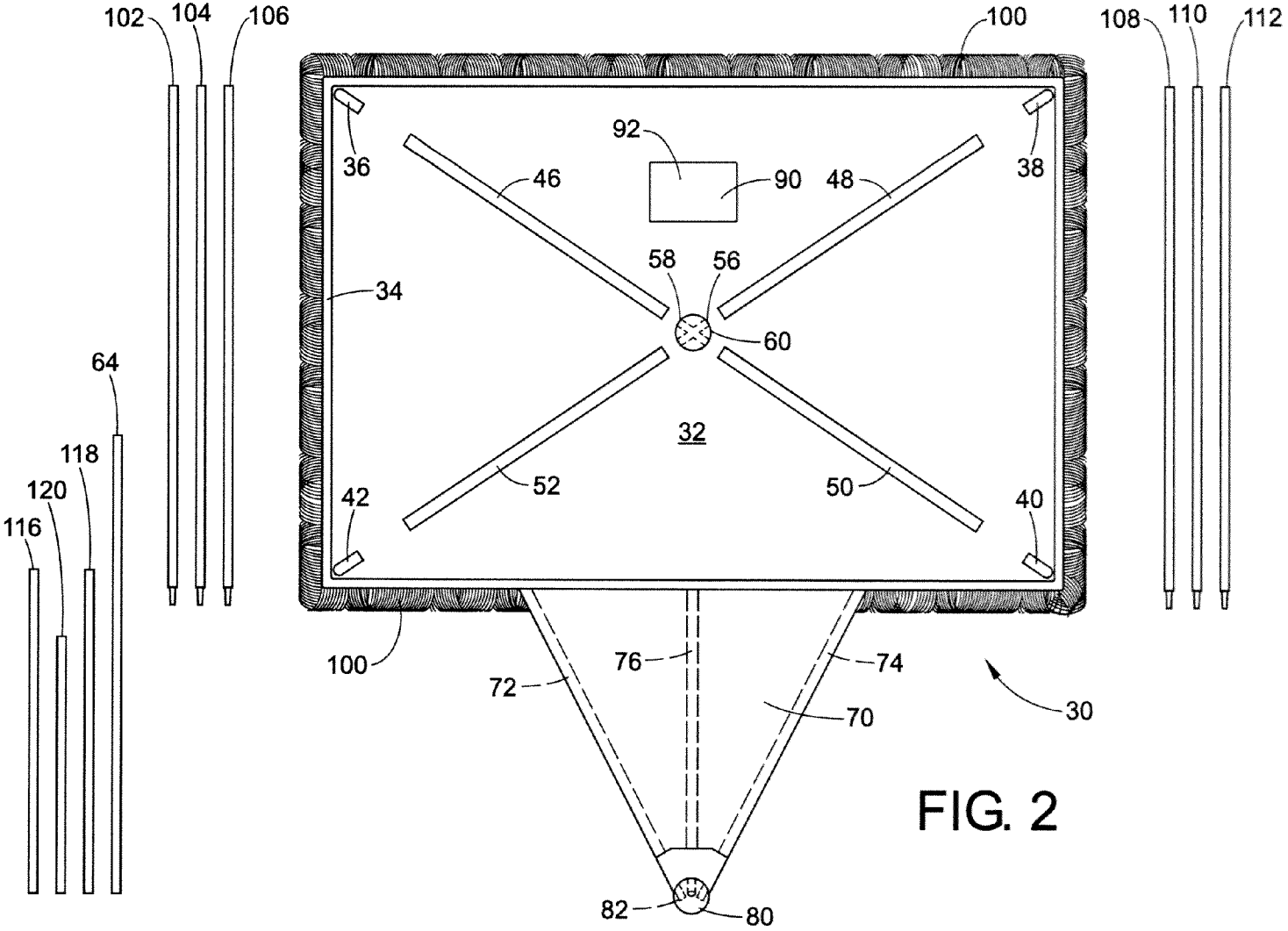
FIG. 2 is a schematical plan presentation of the components of the fireplace draft blocker of the present disclosure in the disassembled state.

FIG. 2 illustrates the components of the fireplace draft blocker 30 in the dissembled state. A rectangular fireplace opening cover 32 is constructed from a fabric such as flame retardant polyester. The fireplace opening cover 34 has dimensions selected to exceed the width and height of fireplace openings expected to be encountered. The edges of the fireplace opening cover 32 are dressed with a hem 34. Corner sockets 36, 38 40, 42 are provided at the four corners of the fireplace opening cover 32. The corner sockets are simple closed tubular fabric elements sewn to the fireplace opening cover 32 with the opened end of the socket facing the center of the fireplace opening cover 32. Alternatively, the corner sockets 36, 38, 40, 42 can be rigid plastic sockets sewn, riveted or otherwise fixed to the fireplace opening cover 32. Four tubular elements 46, 48, 50, 52 are fixed to the fireplace opening cover 32 with the tubular elements extending between the corner sockets and the center of the fireplace opening cover 32. The four tubular elements 46, 48, 50 and 52 are preferably simple fabric tubes sewn to the fireplace opening 32. The tubular elements do not extend all the way to the sockets or to the center of the fireplace opening cover 32. A central socket 56 is shown at the center of the fireplace opening cover 32. The central socket 56 is not necessarily fixed to the fireplace opening cover 32. The central socket 56 has two tunnels, 58, 60 which, preferably, are non-intersecting. The central socket 56 also has a support recess adapted to receive one end of a support rod 64.

Alternatively, the central socket 56 can be provided with four blind holes rather than tunnels and the tubular elements sized to extend from the central socket 56 to the corner sockets 36, 38, 40, 42.

A support base 70 is a triangular shaped piece of fabric constructed from the same material as the fireplace opening cover 32. The support base 70 is preferably an isosceles triangle with its base sewn to the center bottom edge of the fireplace opening cover 32. The support base 70 is hemmed on the other two edges 72, 74 creating base tubular elements along the two edges. A central base tubular element 76 is formed by sewing a strip of material from the apex 80 of the support base 70 to the center of the lower edge of the fireplace opening cover 32. The apex 80 of the support base 70 has a support socket 82. The support socket 82 can be a simple fabric triangle sewed along two edges of support base 70 with an open end or ore robust solid plastic piece fixed to the support base 70.

The fireplace opening cover 32 has an aperture 90 in its upper half. The aperture 90 is closed by sewing or otherwise fixing a sheet 92 of low melting point plastic (low melt plastic) to the fireplace opening cover 32 around the entire periphery of the aperture 90. The low melt plastic sheet is preferably a polyethylene sheet with a melting temperature of around 250° F. (180° C.). This melting temperature is significantly below the melting temperature of the fireplace opening cover 32.

A sealing element 100 is fixed to the fireplace opening cover 32 around its entire periphery. The sealing element 100 is preferably a faux fur element, a bristle element, or a very loose, floppy, soft fabric element. The faux fur option resembles the faux fur seen on many garments, particularly around the hoods of parkas and the like. It provides an air flow blocking function and will engage and fill irregular surfaces. The bristle option is similar but uses a more directed body of soft bristles of selected length similar to what one sees in soft paint brushes. The fabric option uses one and preferably more layers of fabric approximately two inches wide sewn to the periphery of the fireplace opening cover 32. The fabric is very loose and flexible and can engage an irregular surface easily.

Three rod segments 102, 104, 106 are provided with recesses in one end and projections on the other end matching those recesses. Such recesses and projections are commonly used to allow the joining of rod segments in an end to end relationship forming a longer rod. Such joints are often called ferrules. The three rod segments 102, 104, 106 are assembled together, end to end, to form a rod of appropriate length to extend between opposite corners 36, 40 of the fireplace opening cover 32. The assembled rod segments 102, 104, 106 have a length slightly greater than the distance between the corners 36, 40 causing the assembled rod segments to arch or form a bow when assembled as described.

Rod segments 108, 110, 112 are identical to rod segments 102, 104, 106 and can be assembled to form a rod appropriate for extending between sockets 38, 42.

Figure 3:
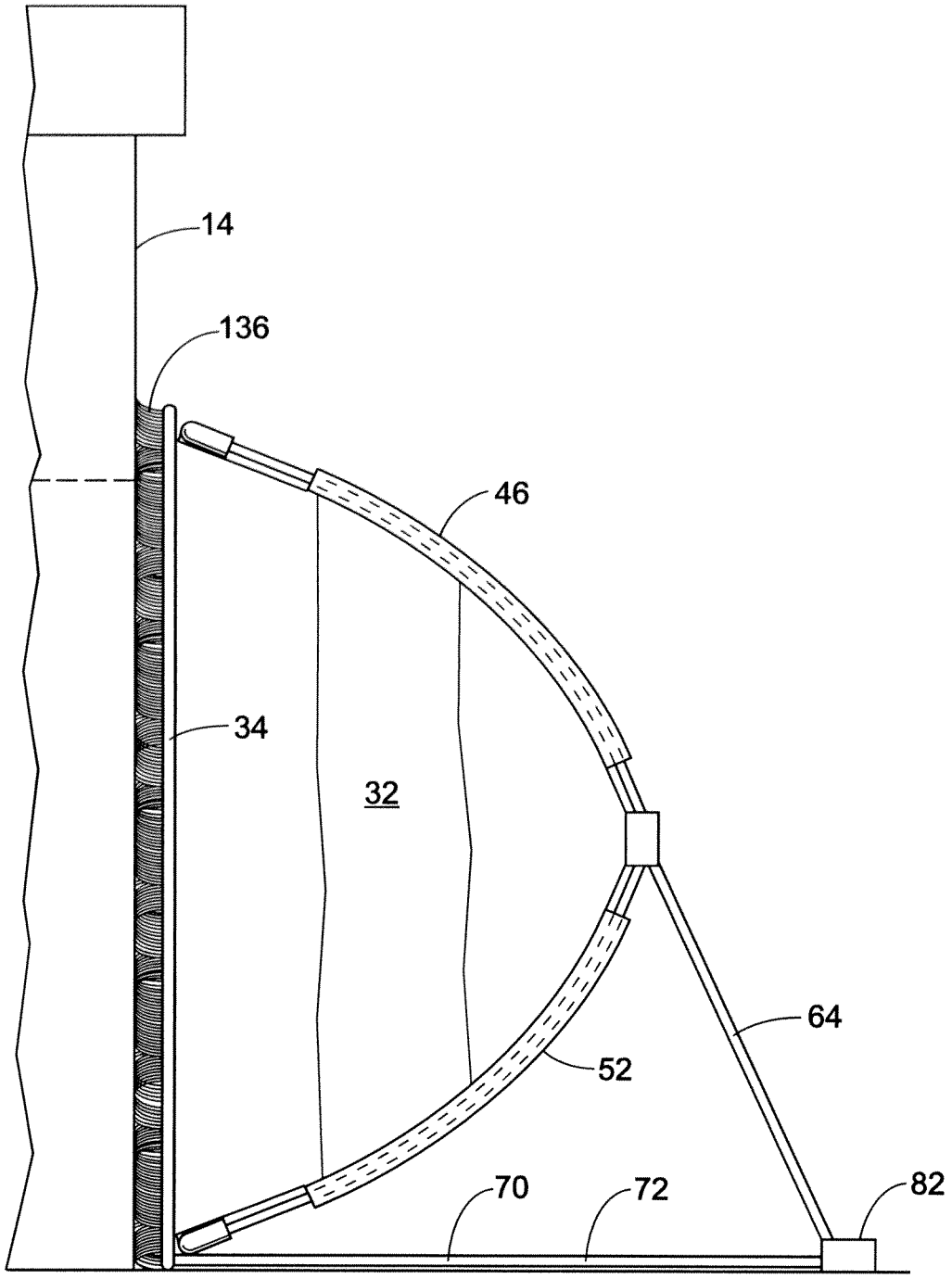
FIG. 3 is a side elevation of the assembled draft blocker applied to the front opening of the fireplace.

Two base edge rod elements 116, 118 are adapted to fit into the base edge hem 72, 74 and a base center rod element 120 is adapted to fit into the base central tubular element 76. These three rod elements 116, 118, 120 also are engaged by the support socket 82. The rod elements hold the support socket 82 away from the fireplace opening cover 32 and maintain the shape of the support base 70. The rod elements in the base, 116, 118, 120 are optional. When the rod elements are assembled with the fireplace opening cover 32 and support base 70, a configuration such as seen in FIG. 3 is created. The rod elements 102, 104, 106, 108, 110, 112 extend from the corner sockets 36, 38, 40, 42 through the tubular elements 46, 48, 50, 52 and through the tunnels 58, 60 in the central socket 56. The rod elements form an X pattern extending between opposite corners of the fireplace opening cover 32. Because the assembled rod elements are slightly longer than the distances between the corners they interconnect, the rod elements bow outwardly and pull the fireplace opening cover 32, by means of the tubular elements, into a convex shape when viewed from the outside of the fire place. This prevents the fabric of the fireplace opening cover 32 being drawn into the firebox 12 and into possible contact with embers from a fire. As can be seen in FIG. 3, the support rod 64 extends from the support socket 82 to the central socket 56. This holds the central socket 56 at appropriate height above the support base 70 and the hearth 16 upon which it sits. The central socket 56 is rigidly connected to the four corner sockets 36, 38, 40, 42 by the assembled rod elements. Thus, the corners of the fireplace opening cover 32 are held against the wall face 14 surrounding the firebox 12. Moreover, the edges of the fireplace opening cover 32 are held in tension by the spring action of the bowed rod segments 102, 104, 106, 108, 110, 112 and held against the wall face 14 as well.

Figure 4:
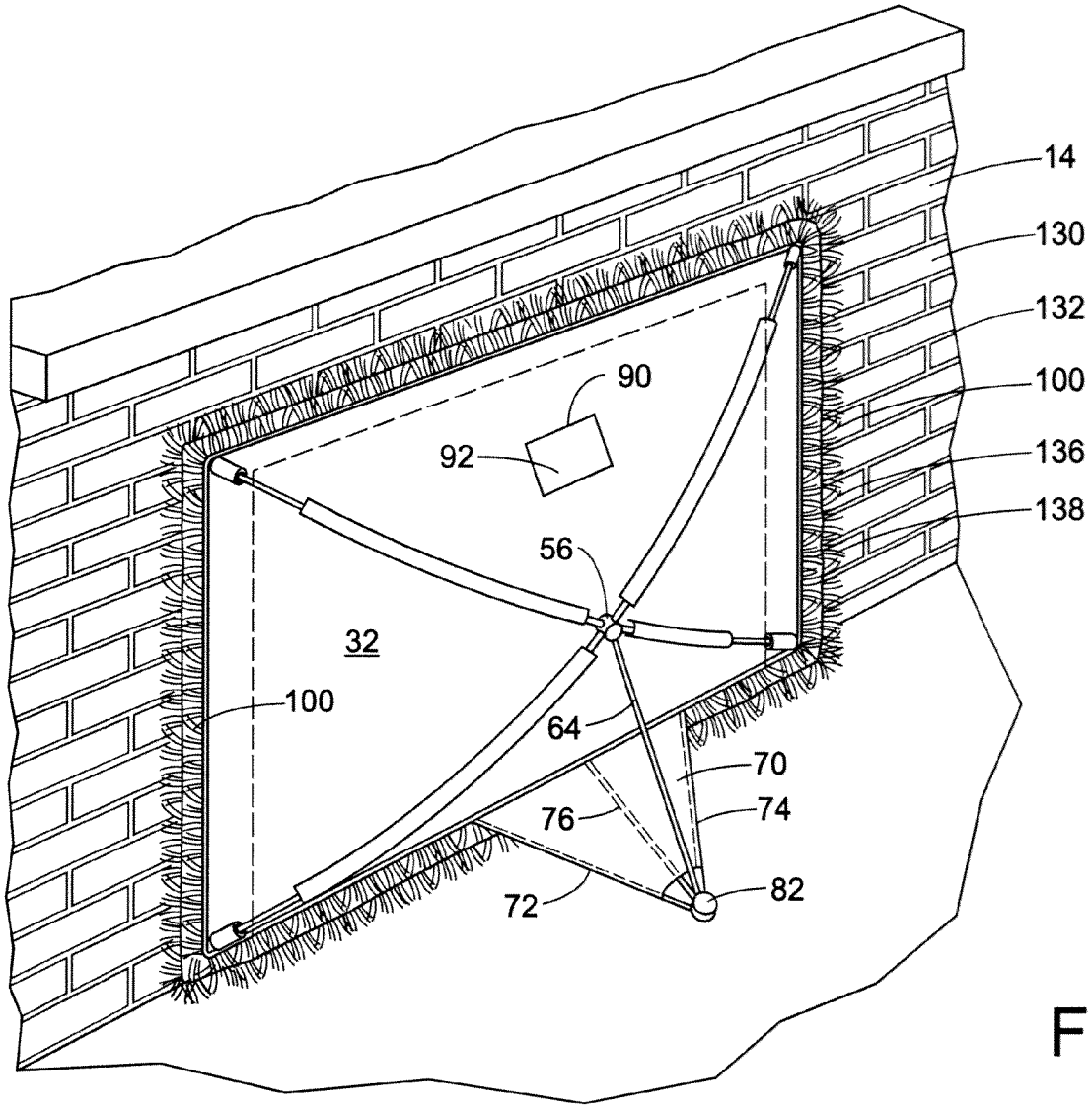
FIG. 4 is a schematical front perspective view of a fireplace as seen in FIG. 1 with the fireplace draft blocker of the present disclosure in place.
Figure 5A:
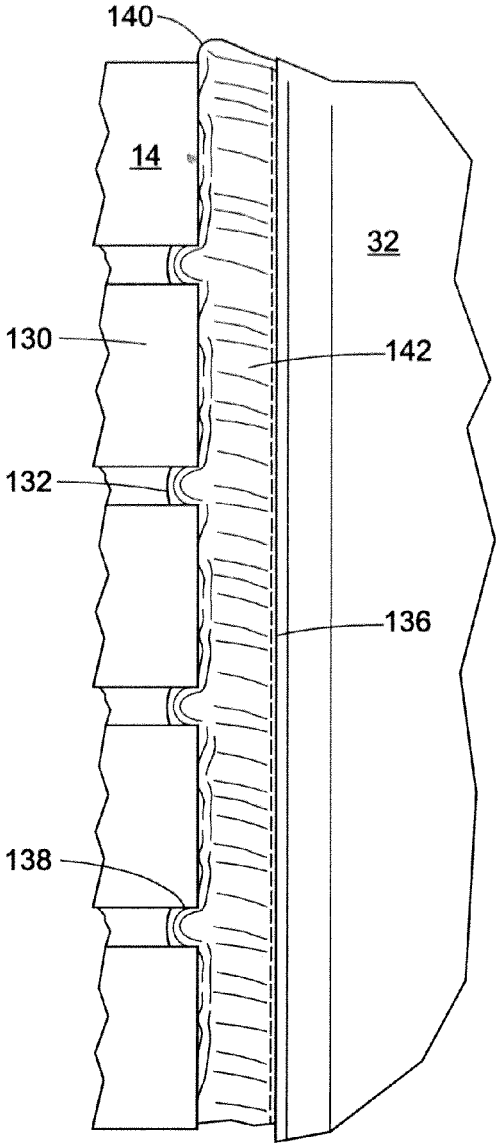
FIG. 5A is detailed view of a portion of the periphery of an alternate embodiment of the draft blocker seen in FIGS. 1-4.
Figure 5B:
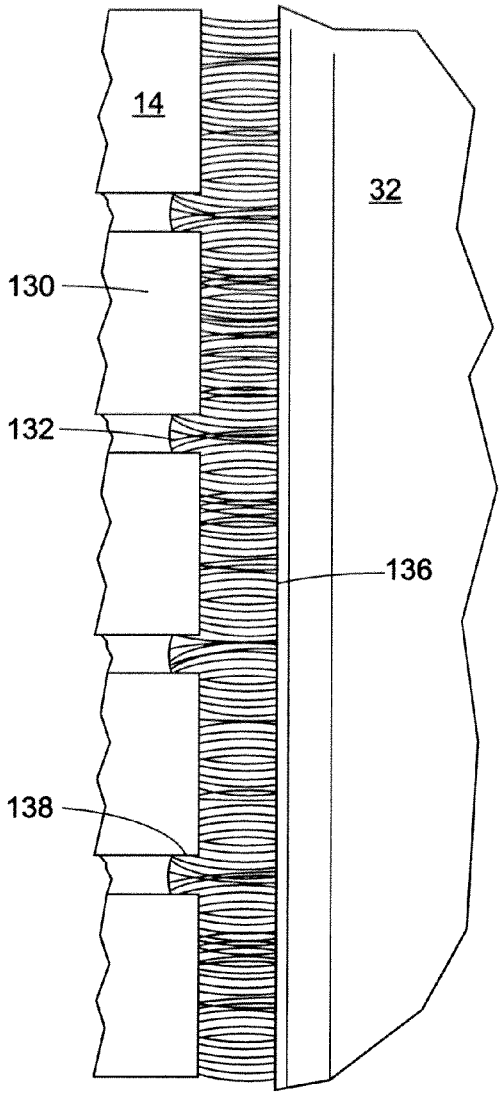
FIG. 5B is a detailed view of a portion of the periphery of the embodiment of the draft blocker seen in FIGS. 1-4.

With reference to FIGS. 4 and 5B, the wall face 14 is seen to comprise bricks 130 joined together by mortar joints 132. This results in a crenelated fascia with flat areas formed by the brick surfaces separated by grooves or recesses at the mortar joints. A portion of the fireplace opening cover 32 overlays a portion of the wall face 14. In the embodiment seen in FIGS. 4 and 5B, the sealing element 100 is formed of faux fur or bristle elements 136. The faux fur or bristle elements consists of thousands of fibers fixed at one end and free at the other end. The fibers are somewhat parallel but often crossing and somewhat random. The fibers are free to lay against the surface of the bricks 130 and also to lay in the recesses formed by the mortar joints 132. In many situations, a draft into a fireplace from the home is the predominate means of energy loss through a fireplace. With such a draft, the fibers 138 of the faux fur are drawn into contact with the bricks 130 and the mortar joints 132 forming a seal around the periphery of the fireplace opening cover 32. This seal continues on both the side edges of the firebox, across the top of the firebox, and at the point where the hearth underlays the firebox. The faux fur or bristle elements are sewn or otherwise fixed around the periphery of the fireplace opening cover 32.

FIG. 5A illustrates a fabric sealing element against a brick 130 and mortar joint 132 wall face 14. Again, a portion of the fireplace opening cover 32 overlays a portion of the wall face 14. One or more layers of a soft fabric are sewn around the periphery of the fireplace opening cover 32 and are about 2 inches wide. Two fabric layers 140, 142 are preferred. The fabric in the preferred embodiment is a velour fabric which is very soft and conformable. The fabric can be sewn to the periphery of the fireplace opening cover 32 with some bunching so that its length is somewhat greater than the length of the edge of the fireplace opening cover 32 to which it is sewn. Because the velour fabric is very soft and conformable, it easily seals against the bricks 130 and mortar joints 132 even though the mortar joints are recessed with respect to the brick. In many heat loss situations through a fireplace, the heat loss is by means of a draft from the interior space into the fireplace and out of the flue. In such a situation, the draft will pull the velour fabric into close contact with the bricks 130 and mortar joints 132 forming a good seal.

As can be seen with references to FIG. 2, fireplace draft blocker 30 is easily assembled and disassembled. The fireplace draft blocker is completely portable in that it is not fixed to the structure of the fireplace in any way. When it is not in use, it can be picked up and moved to a convenient location or disassembled and put away. When use is desired, it is assembled, and placed against the fireplace. The fabric from which the fireplace draft blocker 30 is constructed is selected to be attractive and unobtrusive when used against a fireplace.

The fireplace draft blocker 30 may be assembled and placed against the wall face 14 around fireplace 10 soon after a fire is believed to be extinguished. If, however, the fire is still in process in the fireplace, problems may be encountered if the fireplace draft blocker 30 is left in place for a period of time and then suddenly removed allowing quantities of air containing oxygen to reach a dormant fire quickly. To prevent this situation, the low melt plastic sheet 92 acts as a thermal fuse. If the fireplace draft blocker 30 is placed against the fireplace when a fire is still creating significant amounts of heat, the temperature within the firebox is likely to increase to a point exceeding the melt temperature of the low melt plastic sheet 92. At this point, the low melt plastic sheet will melt and rupture allowing air and oxygen in a controlled amount to enter the firebox 12. The fire may then burn itself out or the home user is alerted to the fact that a fire still exists within the fireplace and the user is alerted to the dangerous condition.

Figure 6:
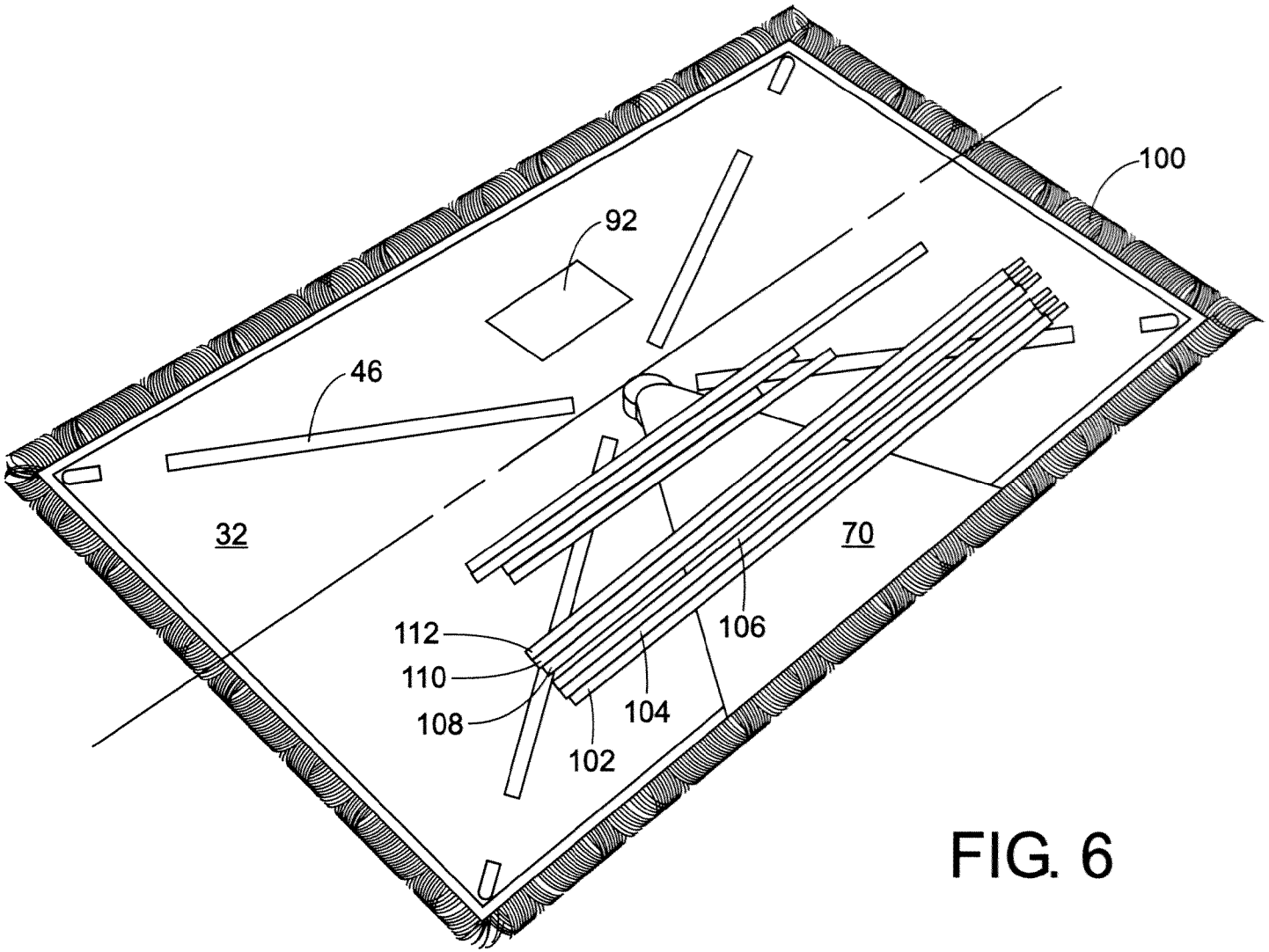
FIG. 6 is a schematical plan presentation of the components of the fireplace draft blocker of the present disclosure disassembled and arranged for packaging.
Figure 7:
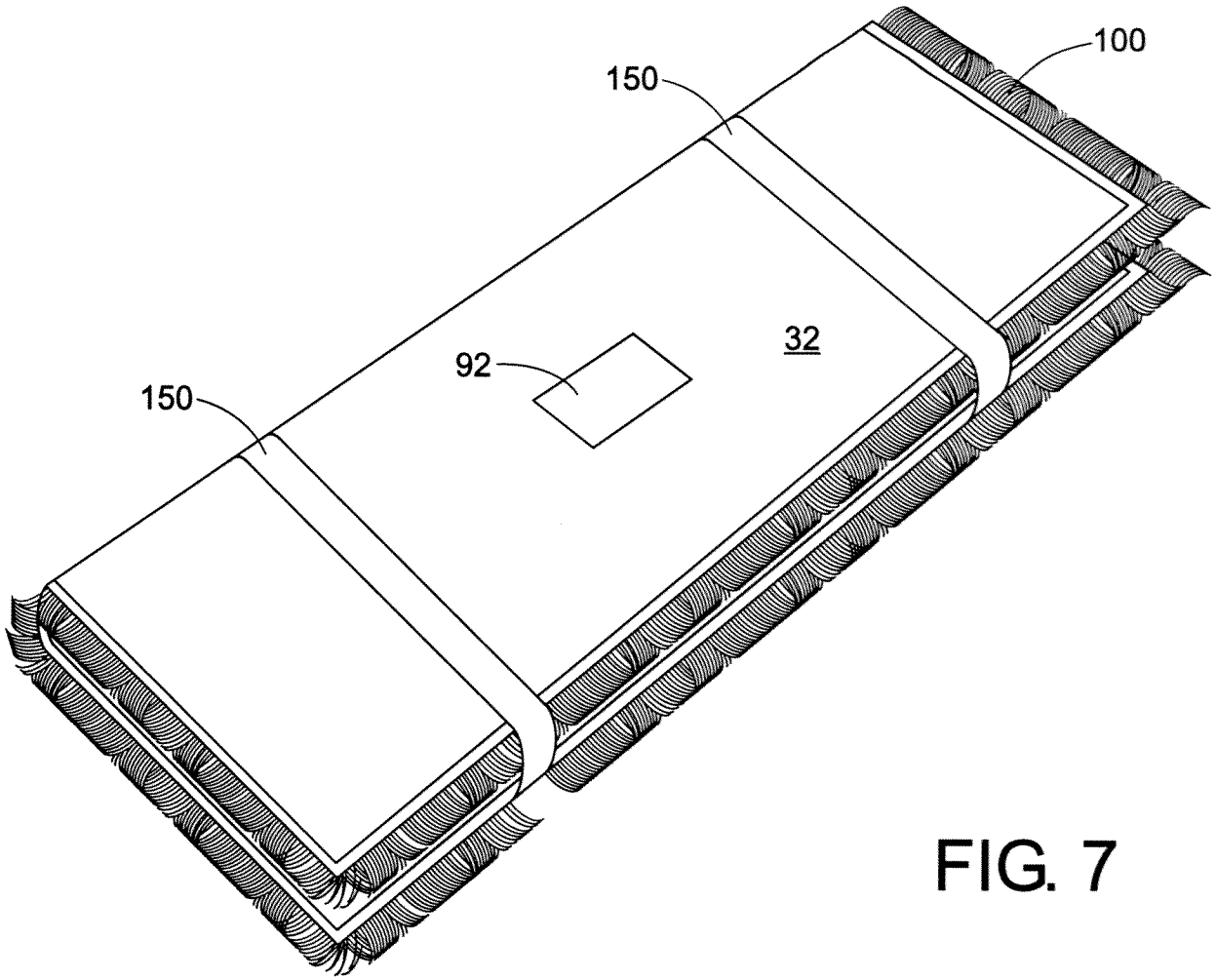
FIG. 7 is a schematical plan presentation of the components seen in FIG. 6 strapped and ready for packaging; and, FIG. 8 shows an alternate packaging arrangement for fireplace draft blocker of FIGS. 1-5.

FIG. 6 shows the fireplace draft blocker components disassembled and arranged for packaging or storage. The support base 70 is folded onto the opening cover 32 and the tubular elements are laid on top of the opening cover 32 parallel to one another. The opening cover 32 is then folded one or more times as seen in FIG. 7. The folded ensemble may then be secured by straps or cords 150 and placed in a box for sale.

Figure 8:
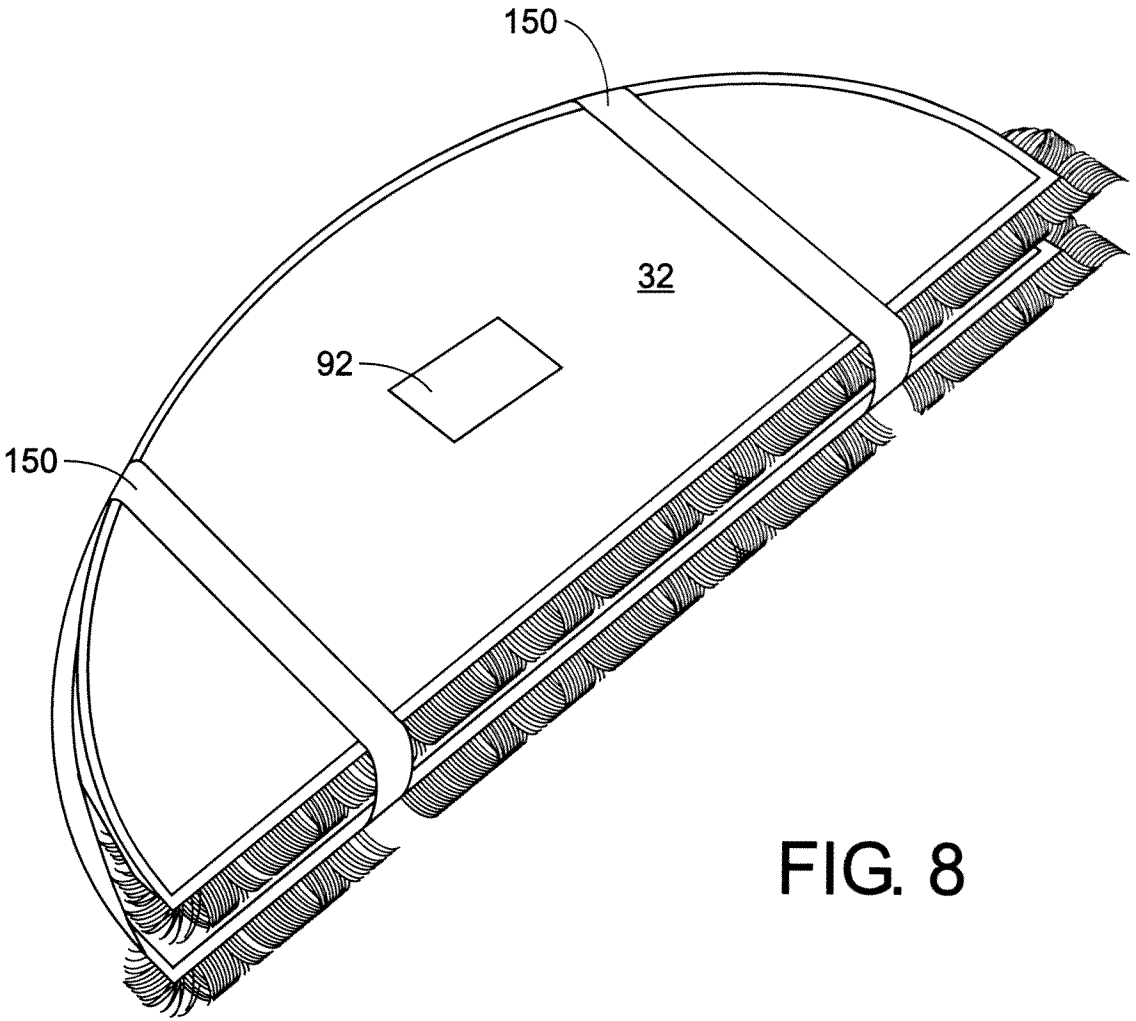

FIG. 8 shows an alternate way of storing the fireplace draft blocker 30. Rather than disassembling all of the rod elements from the fireplace opening cover 32, the rod elements 102, 104, 106, 108, 110 and 112 are left in place. The base rod elements 116, 118, 120 are also left in the base. The support rod 64 is removed from the control socket 56 and support socket 82. The top corners 36, 38 of the fireplace opening cover 32 are pushed into closer proximity with the bottom corners 42, 40. The base is folded against the cover 32 with the support rod 64 captured in the fold. Because the rod elements are flexible, they may arch slightly more allowing this compression and creating a much reduced size for the fireplace draft blocker for easy storage. The fireplace opening cover 32 is held in this compressed state by straps or cords 150. Of course, if desired, the rod elements may all be removed from the tubular elements 46, 48, 50, 52 and corner sockets 36, 38, 40, 42 allowing the user to fold up the fireplace opening cover 32 and store the fireplace draft blocker 30 in a very compact container.

The disclosure has been described with reference to preferred embodiments. Obviously, modifications and alterations will occur to others upon the reading and understanding of the specification. It is intended to include all such modifications and alterations insofar as they come within the scope of the appended claims or the equivalents thereof.

Having thus described the disclosure, it is claimed:

1. A removable fireplace draft blocker adapted to limit the flow of air into a fireplace having a generally vertical opening with a width and a height, the fireplace draft blocker comprising:

a generally rectangular, flexible, air impervious fireplace opening cover having a width at least as wide as the fireplace opening width, a height at least as high as the fireplace opening height, an upper left corner, an upper right corner, a lower left corner, a lower right corner, a center, and, a periphery;

sockets at the upper left corner, upper right corner, lower left corner, and lower right corner of the opening cover;

a first rod extending between the upper left corner and the lower right corner;

a second rod extending between the upper right corner and the lower left corner;

a support including a support rod propping the opening cover adjacent the fireplace opening;

a sealing element fixed to the periphery of the opening cover, the sealing element selected from faux fur, and a body of bristles; and, wherein the first rod, the second rod, and the support rod are connected together by a fitting.

2. The fireplace draft blocker of claim 1 further comprising tubular elements extending from the four corners of the opening cover toward the opening cover center and the rods extend between the corners within the tubular elements.

3. The fireplace draft blocker of claim 2 wherein the first rod is longer than the shortest distance between the upper left corner and the lower right corner, and the second rod is longer than the shortest distance between the upper right corner and the lower left corner, whereby the rods are forced into an arch and the center of the fireplace opening cover is held out of the plane containing the four corners.

4. The fireplace draft blocker of claim 1 wherein the first rod and the second rod are composed of several rod segments removable fitted together in end to end relationship.

5. The fireplace draft blocker of claim 4 wherein the first rod and the second rod are composed of three rod segment removable fitted together in end to end relationship.

6. The fireplace draft blocker of claim 1 wherein the opening cover has an aperture, the aperture being closed by a plastic sheet adapted to rupture when the temperature in the fireplace exceeds a selected temperature whereby air is admitted to the fireplace at a controlled rate, the plastic sheet melting at a lower temperature than the opening cover.

7. The fireplace draft blocker of claim 1, wherein the sealing element includes a width greater than the width of the fireplace opening cover, and a height greater than the height of the fireplace opening cover.

8. The fireplace draft blocker of claim 1, wherein the support includes:

the fitting having a central socket generally centered at the midpoints of the first rod and the second rod;

a support socket distal to the fireplace opening cover; and the support rod extending from the central socket to the support socket.

9. A removable fireplace draft blocker adapted to limit the flow of air into a fireplace having a generally vertical opening with a width and a height, the fireplace draft blocker comprising:

a generally rectangular, flexible, air impervious fireplace opening cover having a width at least as wide as the fireplace opening width, a height at least as high as the fireplace opening height, an upper left corner, an upper right corner, a lower left corner, a lower right corner, a center, and, a periphery;

sockets at the upper left corner, upper right corner, lower left corner, and lower right corner of the opening cover;

a first rod extending between the upper left corner and the lower right corner;

a second rod extending between the upper right corner and the lower left corner;

a support including a support rod propping the opening cover adjacent the fireplace opening;

a seal separate and extending from the fireplace opening cover, the seal extending circumferentially around the fireplace opening cover; and, wherein the support includes a central socket generally centered at the intersection of the first rod and the second rod, a support socket distal to the fireplace opening cover, and a support rod extending from the central socket to the support socket.

10. The fireplace draft blocker of claim 9, wherein the fireplace opening cover is a convex shape.

11. A removable fireplace draft blocker adapted to limit the flow of air into a fireplace having a generally vertical opening with a width and a height, the fireplace draft blocker comprising:

a generally rectangular, flexible, air impervious fireplace opening cover having a width at least as wide as the fireplace opening width, a height at least as high as the fireplace opening height, an upper left corner, an upper right corner, a lower left corner, a lower right corner, a center, and, a periphery;

sockets at the upper left corner, upper right corner, lower left corner, and lower right corner of the opening cover;

a first rod extending between the upper left corner and the lower right corner;

a second rod extending between the upper right corner and the lower left corner;

a support including a support rod propping holding the opening cover adjacent the fireplace opening;

a seal separate and extending from the fireplace opening cover, the seal extending circumferentially around the fireplace opening cover; and, wherein the first rod, the second rod, and the support rod are connected together by a fitting; and the first rod and the second rod bow outwardly thereby pulling the fireplace opening cover into a convex shape.

12. The fireplace draft blocker of claim 11, further comprising tubular elements extending from the four corners of the opening cover toward the opening cover center and the rods extend between the corners within the tubular elements.

13. The fireplace draft blocker of claim 11, wherein the first rod is longer than the shortest distance between the upper left corner and the lower right corner, and the second rod is longer than the shortest distance between the upper right corner and the lower left corner, whereby the rods are forced into an arch and the center of the fireplace opening cover is held out of the plane containing the four corners.

* * * * *